United States Patent [19]

Keal, Jr.

[11] Patent Number: 4,567,067

[45] Date of Patent: Jan. 28, 1986

[54] METHOD OF SURFACE TREATMENT OF ALUMINUM KILLED STEEL IN PREPARATION FOR PORCELAIN COATING

[75] Inventor: Charles Keal, Jr., Connersville, Ind.

[73] Assignee: Design & Manufacturing Corporation, Connersville, Ind.

[21] Appl. No.: 726,684

[22] Filed: Apr. 24, 1985

[51] Int. Cl.[4] ..... B05D 7/14; B05D 1/02; B05D 3/10

[52] U.S. Cl. ..... 427/328; 427/309

[58] Field of Search ..... 427/309, 328

[56] References Cited

U.S. PATENT DOCUMENTS

| | | | |
|---|---|---|---|
| 2,748,066 | 5/1956 | Whitehouse et al. | 427/328 X |
| 3,120,458 | 2/1964 | Evelbauer | 427/328 X |
| 3,723,162 | 3/1973 | Leontaritis et al. | 427/328 X |
| 3,956,536 | 5/1976 | Schoenemann et al. | 427/328 |

*Primary Examiner*—James R. Hoffman
*Attorney, Agent, or Firm*—Frost & Jacobs

[57] ABSTRACT

A surface treatment process for parts fabricated of aluminum killed steel in preparation for porcelain coating wherein the parts are subjected to a plurality of sequential liquid spraying treatments as follows:

(1) An aqueous alkaline cleaning solution at a temperature of about 180° F. (about 82° C.);
(2) A first water rinse;
(3) An aqueous ferric sulfate solution having a concentration of from about 0.5% to about 1% and a temperature of from about 155° F. to about 160° F. (about 68° C. to about 71° C.);
(4) A second water rinse;
(5) An aqueous sulfuric acid solution having a concentration of about 2.5% and a temperature of about 140° F. (about 60° C.);
(6) A third water rinse;
(7) An aqueous nickel sulfate solution having a nickel concentration of from about 2 to about 2.5 oz./gal. and a temperature of about 150° F. (about 65° C);
(8) An aqueous sulfuric acid solution having a concentration of about 0.35% to about 0.45% and a temperature of from about 130° F. (54° C.) to about 140° F. (60° C.);
(9) An alkaline neutralizer spray; and
(10) A fourth water rinse the final portion of which is with deionized water.

14 Claims, No Drawings

METHOD OF SURFACE TREATMENT OF ALUMINUM KILLED STEEL IN PREPARATION FOR PORCELAIN COATING

TECHNICAL FIELD

The present invention is directed to a surface treatment of steel, and more particularly to a surface preparation method of aluminum killed steel for subsequent procelain coating.

BACKGROUND ART

For deep drawing applications in the manufacture of appliances and the like, prior art workers have used both rimming and aluminum killed steels. Rimming steel (core killed steel) is cheaper to manufacture and has cleaner surface properties both in the ingot form and as rolled. A small amount of temper rolling after annealing will eliminate as-annealed yield point elongation (YPE), but the steel will still age at ordinary room temperature (about 23° C.) in about two months, resulting in the return of objectionable yield point elongation.

The present invention will be described in terms of a pickling or surface treatment process applied to the vats and doors of dishwashing machines. This is to be considered exemplary only and is not intended to constitute a limitation on the present invention. It will be evident that teachings of the present invention will be equally applicable to the vats and doors of clothes washing machines and other porcelain coated appliances and the like.

In an exemplary prior art surface preparation treatment for the subsequent porcelain coating of dishwasher vats and doors fabricated from rimming steel, the vats and doors were suspended from a conveyor and sprayed with a series of liquids. Specifically, an exemplary prior art surface preparation treatment involved the following sequence of steps:

(1) The suspended vats and doors were sprayed with an aqueous alkaline cleaning solution (such as a sodium hydroxide solution), at a temperature of about 180° F. (about 82° C.). The purpose of this step was to remove oil and other residue having accumulated during fabrication and transportation to the porcelain plant.

(2) The suspended vats and doors were thereafter subjected to a first water rinsing step to remove the alkaline cleaning solution. This rinsing step included the spraying of the vats and doors first with recirculating warm water, followed by spraying with recirculating cold water, and finally followed by spraying with fresh water.

(3) The doors and vats were thereafter sprayed with an aqueous ferric sulfate solution having a concentration of from about 3% to about 3.5% and a temperature of from about 165° F. to about 170° F. (about 74° C. to about 77° C.). The ferric sulfate solution was made by injecting a ferrous sulfate solution with a hydrogen peroxide solution having a concentration of from about 5% to about 8%. This step is an etching phase of the process.

(4) The vats and doors were thereafter sprayed with a recirculating water rinse, as a second water rinse to flush away the ferric sulfate solution.

(5) The vats and doors were next sprayed with an aqueous sulfuric acid solution having a concentration of from about 5% to about 6% and a temperature of about 160° F. (about 71° C.). The purpose of this step was again to etch the surface of the steel.

(6) The suspended vats and doors were thereafter subject to a third water rinse comprising recirculating and fresh water rinse sprays to eliminate any acid remaining from step 5.

(7) An aqueous nickel sulfate solution, having a nickel concentration from about 2 to about 2.5 oz./gal., and a temperature of about 170° F. (about 77° C.) was sprayed on the suspended vats and doors to deposit a coating of nickel on the steel. The nickel coating is important for good adherence of the porcelain on the steel.

(8) The suspended vats and doors were thereafter treated with a rinsing spray of an aqueous sulfuric acid solution having a very low concentration of about 0.35% to about 0.45%. The purpose of this step is to remove iron (rust) that may have dissipated on the surface of the rimming steel vats and doors during the application of the nickel sulfate solution (step 7).

(9) The suspended doors and vats were then sprayed with an alkaline neutralizer such as a soda ash solution, to terminate the corrosive action of any of the previous solutions.

(10) The strip preparation treatment was completed by a final water rinse comprising a spray of recirculated water followed by a spray of deionized water.

After the above surface preparation steps, the suspended parts were subjected to a heated drying step, followed by a conventional porcelain coating operation. The coating operation may be of any appropriate and well known type, such as dipping the parts in wet porcelain, or subjecting the parts to a direct, dry powder application. Thereafter, the parts were subjected to a conventional baking step at high temperature.

Although the exemplary prior art surface preparation process generally worked well for preparing rimming steel parts for porcelain coating, some problem with "out-gassing" (a pitting condition in the porcelain which may lead to premature rusting of the steel therebeneath) was encountered.

Recently, with the impropvements in its manufacturing process and properties, a great deal of interest has been shown in the use of aluminum killed steel. Aluminum killed steel will be permanently non-aging after a small amount of temper rolling following an anneal, so long as it is not exposed to elevated temperatures prior to forming or deep drawing. Some difficulties have been encountered in preparing the surfaces of parts made from aluminum killed steel for porcelain coating. For example, the above outlined strip preparation process has been found to adversely affect the aluminum killed steel, making it unsuitable for subsequent porcelain coating. Problems manifest themselves such as, for example, pitting of the metal surface. Gas or atmosphere is trapped in the metal surface pitts by the porcelain coating which, when baked, is itself subject to outgassing and increased consequent pitting.

The present invention is based upon the discovery that, with proper modification, a surface preparation process can be provided which will enable satsifactory porcelain coating of parts made from aluminum killed steel. Additional advantages are also achieved. For example, in the practice of the above described prior art process, steps 3 through 5 result in a loss of the base metal of the parts being surface treated. In the practice of the present invention this base metal loss is markedly reduced. It has further been discovered that, in the practice of the present invention, the amount of nickel deposited to provide an acceptable adhesion layer is less than that required by prior art practice, representing a significant cost savings, since the amount of nickel sulfate required is greatly reduced. Finally, accelerated rust tests show that the process of the present invention has largely eliminated the out-gassing and related rust problems inherent in the prior art process outlined above.

DISCLOSURE OF THE INVENTION

According to the invention there is provided an improved surface treatment process in preparation for porcelain coating of parts fabricated from aluminum killed steel. The parts to be surface treated are suspended from a conveyor and moved sequentially through a series of spraying steps. These spraying steps comprise spraying the parts with an alkaline cleaning solution such as a sodium hydroxide solution, at a temperature of about 180° F. (about 82° C.). Thereafter, the parts are conveyed through rinsing sprays constituting a recirculating warm water spray, a recirculating cold water spray and a fresh water spray. The parts are then sprayed with an aqueous ferric sulfate solution having a concentration of from about 0.5% to about 1% and a temperature of from about 155° F. to 160° F. (about 68° C. to about 71° C.). This is followed by a recirculating water rinse spray. Thereafter, the parts are sprayed with an aqueous sulfuric acid solution having a concentration of about 2.5% and a temperature of about 140° F. (about 60° C.). The parts are then again subjected to a rinsing step comprising a recirculating water spray followed by a fresh water spray. An aqueous nickel sulfate solution having a nickel concentration of from about 2 to about 2.5 oz./gal., with a temperature of about 150° F. (about 65° C.) is sprayed upon the parts. Following the nickel depositing step, the parts are subjected to a rinsing spray of an aqueous supheric acid solution of low concentration of about 0.35% to about 0.45%. This, in turn, is followed by a rinsing spray with an alkaline neutralizer such as a soda ash solution. Finally, the parts are subject to a final water rinse comprising a spray of recirculated water followed by a spray of deionized water.

DETAILED DESCRIPTION OF THE INVENTION

As indicated above, the present invention is directed to a surface preparation process for preparing the surface of parts fabricated from aluminum killed steel. The surface preparation process readies the aluminum killed part surfaces for procelain coating. As used herein and in the claims, the term aluminum killed steel refers to laddle aluminum killed, fully decarburized steel, as is well known in the art.

In the practice of the present invention the parts (such as dishwasher vats and doors, for example), having been appropriately fabricated from aluminum killed steel, are subject to a surface treatment or preparation process to ready them for porcelain coating. The surface preparation treatment of the present invention comprises a plurality of spraying steps in sequence, utilizing a series of liquids. While the spraying steps may be conducted in any appropriate manner, a convenient mode of operation involves suspending the parts on a continuous conveyor and conducting the parts past a series of appropriately located spray heads. The process involves the following sequence of spray treatments:

(1) The parts are first sprayed with a non-silicate alkaline cleaning solution such as an aqueous sodium hydroxide solution. The cleaning solution is at a temperature of about 180° F. (about 82° C.) and has a pH of from about 12 to about 14.

(2) The parts are then subject to a first water rinse comprising a recirculating warm water spray, a recirculating cold water spray and a fresh water spray.

(3) The parts are thereafter sprayed with an aqueous ferric sulfate solution having a concentration of from about 0.5% to about 1% and a temperature of from about 155° F. to about 160° F. (about 68° C. to about 71° C.).

(4) A second water rinse step is applied to the parts using a recirculating water spray.

(5) A sulfuric acid spray is then imparted to the parts, utilizing an aqueous solution of sulfuric acid having a concentration of about 2.5% and a temperature of about 140° F. (about 60° C.).

(6) The parts are then directed through a third water rinse comprising a recirculating water spray and a fresh water spray.

(7) An aqueous nickel sulfate solution having a nickel concentration of about 2 to about 2.5 oz./gal. and a temperature of about 150° F. (about 65° C.) is sprayed on the parts.

(8) The parts are then subjected to a rinsing spray utilizing an aqueous sulfuric acid solution of a low concentration of about 0.35% to about 0.45% and a temperature of from about 130° F. (54° C.) to about 14° F. (60° C.).

(9) An alkaline neutralizer such as an aqueous soda ash solution, having a concentration of from about 0.25% to about 0.30%, is then sprayed upon the parts.

(10) The parts are subjected to a fourth final water rinse comprising a spray of recirculated water followed by a spray of deionized water.

In the above noted series of steps according to the present invention, it will be noted that steps 1 and 2 are substantially identical to prior art steps 1 and 2. The purpose of the alkaline cleaning solution spray is to remove oil and other residue accumulating on the parts during fabrication and transfer from the fabricating line to the porcelain line. Excellent results have been achieved with an aqueous sodium hydroxide solution having a concentration of about 1 oz./gal. Almost any non-silicate, alkaline solution could be used. The series of water sprays of the first rinsing step 2 remove the alkaline cleaning solution of step 1 from the parts. This first water rinse is so conducted that the parts do not cool too quickly, to avoid the formation of stresses in the parts. The recirculating warm water spray is not temperature controlled. The warm water has a temperature of about 120° F. (49° C.) derived from the parts being sprayed.

It will be noted that in step 3 of the process of the present invention both the concentration and temperature of the ferric sulfate solution is reduced as compared to step 3 of the prior art process. This is an etching step during which iron is removed from the surface of the steel. The aqueous ferric sulfate solution attacks iron specifically and is therefore the preferred solution for this step.

Step 4 of the process of the present invention is identical to step 4 of the prior art process. This second water rinse, a recirculating water rinse, is used to flush away the ferric sulfate solution of step 3.

In the aqueous sulfuric acid solution spray of step 5 of the present invention, the concentration of the sulfuric acid is reduced and the temperature is decreased. This is another etching step, but less severe than that of step 3. This step tends to smooth the surface roughened by step 3. Other acids, such as nitric acid, could be used for this step. Experience has shown, however, that an aqueous sulfuric acid solution provides superior results.

In the practice of steps 3 through 5 of the prior art process, there was a loss of the base metal (rimming steel) of the parts of from about 3 to about 5 g./sq.ft. In the practice of steps 3 through 5 of the process of the present invention, this base metal loss (aluminum killed steel) is reduced to from about 1 to about 1.5 g./sq.ft.

Step 6 of the present invention is identical to step 6 of the prior art. This third water rinse using recirculating and fresh water sprays, eliminates any acid remaining from step 5.

With respect to step 7 above, nickel is the preferred coating becuse it deposits more efficiently in this type of process than do other metals. Step 7 of the prior art process required a nickel deposit of from about 0.1 to about 0.15 g./sq.ft. to provide an acceptable adhesion layer for the porcelain coating. In the practice of the present invention, utilizing aluminum killed steel as the metal from which the parts are fabricated, it has been found that a nickel deposit of from about 0.04 to about 0.07 g./sq.ft. is sufficient to provide an acceptable adhesion layer for the porcelain coating. This results in a significant cost savings, since the amount of nickel sulfate purchased is greatly reduced.

Step 7 of the present process uses an aqueous nickel sulfate solution at a lower temperature than step 7 of the prior art process. Alternatively, the nickel concentration can be reduced. Temperature and concentration control the rate at which nickel is deposited on the surface of the steel. Experience has shown that a reduction of 10° F. in temperature is approximately equal to a reduction in solution concentration of about 0.5 oz./gal. Thus, alternative process variations equivalent to the 20° F. temperature differential noted above between the prior art process and that of the present invention, would be a reduction of solution concentration of about 1 oz./gal., or a 10° F. temperature reduction together with a 0.5 oz./gal. reduction in solution concentration. In practice, controlling the temperature is preferred as being simpler and easier to accomplish.

The low concentration aqueous sulfuric acid solution rinsing spray of step 8 of the present process is the same as step 8 of the prior art enumerated above. The purpose of this step is to remove iron, in the form of rust, which may have dissipated on the surface of the steel during the application of the nickel sulfate solution spray of step 7. If the sulfuric acid solution temperature is much higher than about 140° F. (60° C.), the solution will start to remove the nickel. Sulfuric acid solution is preferred since other acid solutions do not remove rust as well.

Step 9 of the present process, the alkaline neutralizer spray, is the same as step 9 of the prior art process. The purpose of this step is to terminate the corrosive action of any of the previous spray solutions. Suitable alternatives to soda ash solution may be available, but an aqueous soda ash solution is commonly used throughout the industry.

Finally, the final water rinsing step 10 of the present invention is the same as the final step 10 of the prior art. The deionized water of this last step is used to wash off any of the chemicals or salts remaining on the surface of the part. Since this water is chemically pure, any residue goes into solution more quickly and there is no risk of contamination by traqe elements which might be present in top water.

The porcelain coating procedure, itself, does not constitute a part of the present invention. Suffice it to say that following the strip preparation process steps of the present invention, as enumerated above, parts are subjected to heat to dry them and are then porcelain coated. The porcelain coating operation, itself, can be conducted in any of the well known ways including dipping the parts in wet porcelain, or by way of dry powder application. This is followed by a conventional high temperature baking step at about 1500° F. (about 816° C.), to revitrofy (i.e. melt and resolidify) the porcelain material.

In addition to the advantages enumerated above, it has been found through accelerated rust tests that the process of the present invention largely eliminates outgassing and related rust problems, inherent in the old process. The primary advantage of the process of the present invention lies in the fact that it enables satisfactory porcelain coating of parts made from aluminum killed steel, whereas the prior art process enumerated above would not.

Modifications may be made in the invention without departing from the spirit of it. For example, it would be possible to reverse the order of steps 3 and 5 described above, although the order given is preferred.

What is claimed is:

1. A surface treatment process for metallic parts in preparation for porcelain coating thereof comprising the following steps:

(a) mounting aluminum killed steel parts on a conveyor;

(b) spraying said parts with an aqueous non-silicate alkaline cleaning solution having a temperature of about 180° F. (about 82° C.);

(c) subjecting said parts to a first water rinse spraying treatment;

(d) spraying said parts with an aqueous ferric sulfate solution having a concentration of from about 0.5% to about 1% and a temperature of from about 155° F. to about 160° F. (about 68° C. to about 71° C.);

(e) subjecting said parts to a second water rinse spraying treatment;

(f) spraying said parts with an aqueous sulfuric acid solution having a concentration of about 2.5% and a temperature of about 140° F. (about 60° C.);

(g) subjecting said parts to a third water rinse spraying treatment;

(h) spraying said parts with an aqueous nickel sulfate solution and depositing on said aluminum killed steel parts a nickel adhesion layer of from about 0.04 to about 0.07 g./sq.ft.;

(i) spraying said parts with an aqueous sulfuric acid solution having a concentration of from about 0.35% to about 0.45% and a temperature of from about 130° F. to about 140° F. (about 54° C. to about 60° C.);

(j) spraying said parts with an alkaline neutralizer; and (k) subjecting said parts to a final water rinse spraying treatment.

2. The process claimed in claim 1 wherein said alkaline cleaning solution is an aqueous sodium hydroxide solution having a pH of from about 12 to about 14.

3. The process claimed in claim 1 wherein said first water rinse spraying treatment comprises a recirculating warm water spray followed by a recirculating cold water spray followed by a fresh water spray.

4. The process claimed in claim 1 wherein said second water rinse spraying treatment comprises a recirculating water spray.

5. The process claimed in claim 1 wherein said third water rinse spraying treatment comprises a recirculating water spray followed by a fresh water spray.

6. The process claimed in claim 1 wherein said aqueous nickel sulfate solution has a nickel concentration of from about 2 to about 2.5 oz./gal. and a temperature of about 150° F. (about 65° C.).

7. The process claimed in claim 1 wherein said aqueous nickel sulfate solution has a nickel concentration of from about 1 to about 1.5 oz./gal. and a temperature of about 170° F. (77° C.).

8. The process claimed in claim 1 wherein said aqueous nickel sulfate solution has a nickel concentration of from about 1.5 to about 2 oz./gal. and a temperature of about 160° F. (70° C.).

9. The process claimed in claim 1 wherein said alkaline neutralizer spray comprises an aqueous soda ash solution spray having a concentration of from about 0.25% to about 0.30%.

10. The process claimed in claim 1 wherein said final water rinse spraying treatment comprises a recirculating water spray followed by a deionized water spray.

11. The process claimed in claim 1 wherein said alkaline cleaning solution is an aqueous non-silicate sodium hydroxide solution having a pH of from about 12 to about 14, said first water rinse spraying treatment comprising a recirculating warm water spray followed by a recirculating cold water spray followed by a fresh water spray, said second water rinse spraying treatment comprising a recirculating water spray, said third water rinse spraying treatment comprising a recirculating water spray followed by a fresh water spray, said alkaline neutralizer spray comprises an aqueous soda ash solution spray having a concentration of from about 0.25% to about 0.30%, and said final water rinse spraying treatment comprises a recirculating water spray followed by a deionized water spray.

12. The process claimed in claim 11 wherein said aqueous nickel sulfate solution has a nickel concentration of from about 2 to about 2.5 oz./gal. and a temperature of about 150° F. (about 65° C.).

13. The process claimed in claim 11 wherein said aqueous nickel sulfate solution has a nickel concentration of from about 1 to about 1.5 oz./gal. and a temperature of about 170° F. (77° C.).

14. The process claimed in claim 11 wherein said aqueous nickel sulfate solution has a nickel concentration of from about 1.5 to about 2 oz./gal. and a temperature of about 160° F. (70° C.).

* * * * *